US005803469A

United States Patent [19]

Yoham

[11] Patent Number: 5,803,469

[45] Date of Patent: Sep. 8, 1998

[54] IN-LINE SKATE WITH COLLAPSIBLE WHEEL ASSEMBLY

[76] Inventor: Stephen Yoham, 11031 SW. 51 Ter., Miami, Fla. 33165

[21] Appl. No.: 779,652

[22] Filed: Jan. 15, 1997

Related U.S. Application Data

[60] Provisional application No. 60/010,169 Jan. 16, 1996.

[51] Int. Cl. [6] ..... A63C 3/00

[52] U.S. Cl. ..... 280/11.27; 280/811; 280/825

[58] Field of Search ..... 280/11.27, 11.22, 280/11.2, 825, 7.1, 7.13, 809, 811, 9, 10

[56] References Cited

U.S. PATENT DOCUMENTS

| | | | |
|---|---|---|---|
| 2,035,897 | 3/1936 | Kosanovich | 280/7.13 |
| 3,292,940 | 12/1966 | Weitzner | 280/7.13 |
| 4,928,982 | 5/1990 | Logan | 280/11.22 |
| 5,183,292 | 2/1993 | Ragin, III | 280/825 |
| 5,290,065 | 3/1994 | Kassal | 280/825 |
| 5,299,815 | 4/1994 | Brosnan et al. | 280/11.2 |
| 5,303,955 | 4/1994 | Zurnamer | 280/825 |
| 5,320,367 | 6/1994 | Landis | 280/11.2 |
| 5,531,462 | 7/1996 | Gu | 280/7.13 |
| 5,573,275 | 11/1996 | Smith et al. | 280/825 |
| 5,580,094 | 12/1996 | Ruehlman et al. | 280/825 |
| 5,697,643 | 12/1997 | Marasco et al. | 280/825 |

FOREIGN PATENT DOCUMENTS

| | | | |
|---|---|---|---|
| 309567 | 10/1918 | Germany | 280/7.1 |
| 400873 | 4/1966 | Switzerland | 280/8.25 |

*Primary Examiner*—Brian L. Johnson
*Assistant Examiner*—Bridget Avery
*Attorney, Agent, or Firm*—Robert M. Downey, P.A.

[57] ABSTRACT

An in-line skate having a boot is provided with a roller assembly defined by an elongate rail having a central channel along a length thereof and including a plurality of wheels rotatably supported in spaced, co-planar relation along the length of the channel. The roller assembly mounts to the bottom of the boot and is pivotally movable between locked positions, including a lowered, operable position and a collapsed, stowed position. A rubber mat attached along a side plate of the rail provides a ground engaging cushion sole for walking with the roller assembly in the collapsed, stowed position.

11 Claims, 4 Drawing Sheets

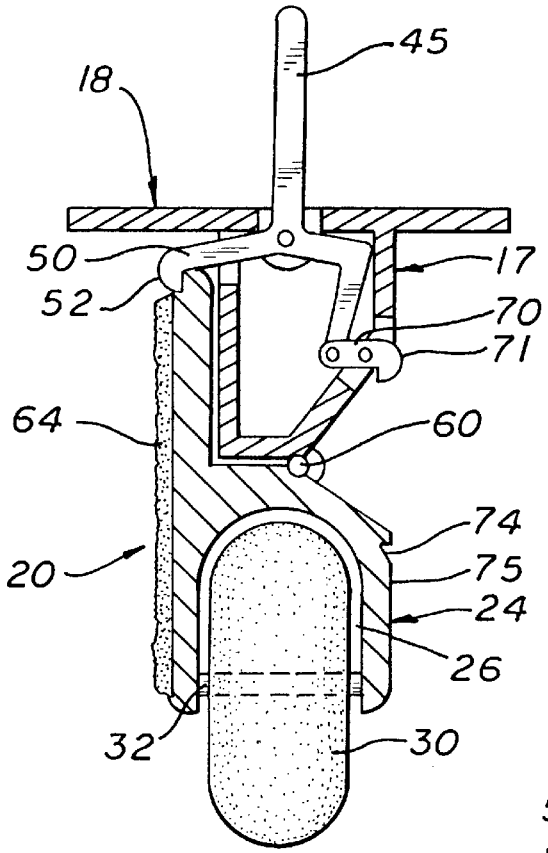
FIG. 3A
FIG. 3B
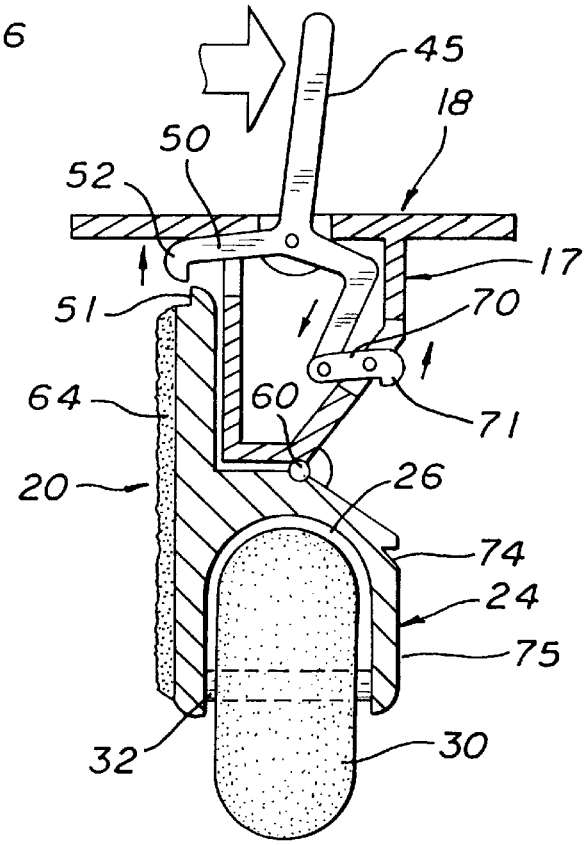
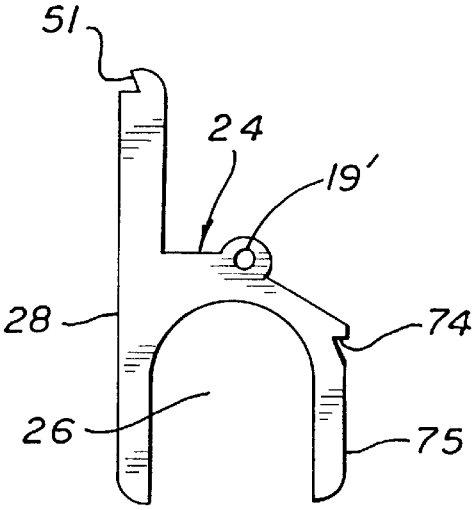
FIG. 4

IN-LINE SKATE WITH COLLAPSIBLE WHEEL ASSEMBLY

BACKGROUND OF THE INVENTION

1. Field of the Invention

The present invention relates generally to in-line skates and, more specifically, to an in-line skate having a collapsible roller assembly so that the skate boots can be worn for skating and walking.

2. Description of the Related Art

In-line skating has become an extremely popular recreational activity among people of all age groups. Most in-line skaters skate not only for fun, but as a means for transportation while achieving a cardiovascular workout, much like bicycling. In fact, it is not uncommon for people to skate to a destination such as a restaurant, outdoor cafe, grocery store, and the like. While skating to such destinations is becoming a quite popular weekend activity for families in towns throughout the country, a problem is presented when the skater reaches the destination. Maneuvering along a crowded sidewalk or in a restaurant or store on in-line skates is difficult and can be a very clumsy and eventful ordeal. However, unless the skater brings along a separate pair of walking shoes, they have no choice but to leave their skates on while dining and/or shopping. Moreover, many establishments have posted restrictions which ban skating on the premises due to the potential liability if a customer or guest is injured.

Accordingly, there exists a need in the field of in-line skating for an in-line skate having a collapsible wheel assembly which will enable the skater to skate to a particular destination and then, after collapsing the wheel assembly, to walk on a cushioned sole in a manner which is not awkward or hazardous and which will not damage floor surfaces.

OBJECTS AND ADVANTAGED OF THE PRESENT INVENTION

With the foregoing in mind, it is a primary object of the present invention to provide an in-line skate having a collapsible wheel assembly which locks between a lowered, operable position for skating and a collapsed, stowed position enabling the skater to walk in the skate boot in a manner much like a conventional shoe.

It is a further object of the present invention to provide an in-line skate which includes a collapsible wheel assembly having a cushioned rubber sole to provide comfort when walking and to further prevent damage to floor surfaces.

It is yet a further object of the present invention to provide an in-line skate which can be used for both skating and walking and which closely resembles a conventional in-line skate in both appearance and function for skating purposes.

It is still a further object of the present invention to provide an in-line skate adapted for use for both skating and walking and which can be manufactured and sold at a price comparable to that of conventional in-line skates.

These and other objects and advantages of the present invention are more readily apparent with reference to the accompanying drawings and the following detailed description.

BRIEF DESCRIPTION OF THE DRAWINGS

For a fuller understanding of the nature of the present invention, reference should be had to the following detailed description taken in connection with the accompanying drawings in which:

FIGS. 3A–3D illustrate, in sequence, operable movement of the roller assembly from a first locked, lowered position defining a skating mode to a second locked, collapsed position shown in FIG. 3D, defining a walking mode;

FIG. 4 is an isolated end elevation of the rail structure of the roller assembly.

DETAILED DESCRIPTION OF THE PREFERRED EMBODIMENT

Figure 1A:
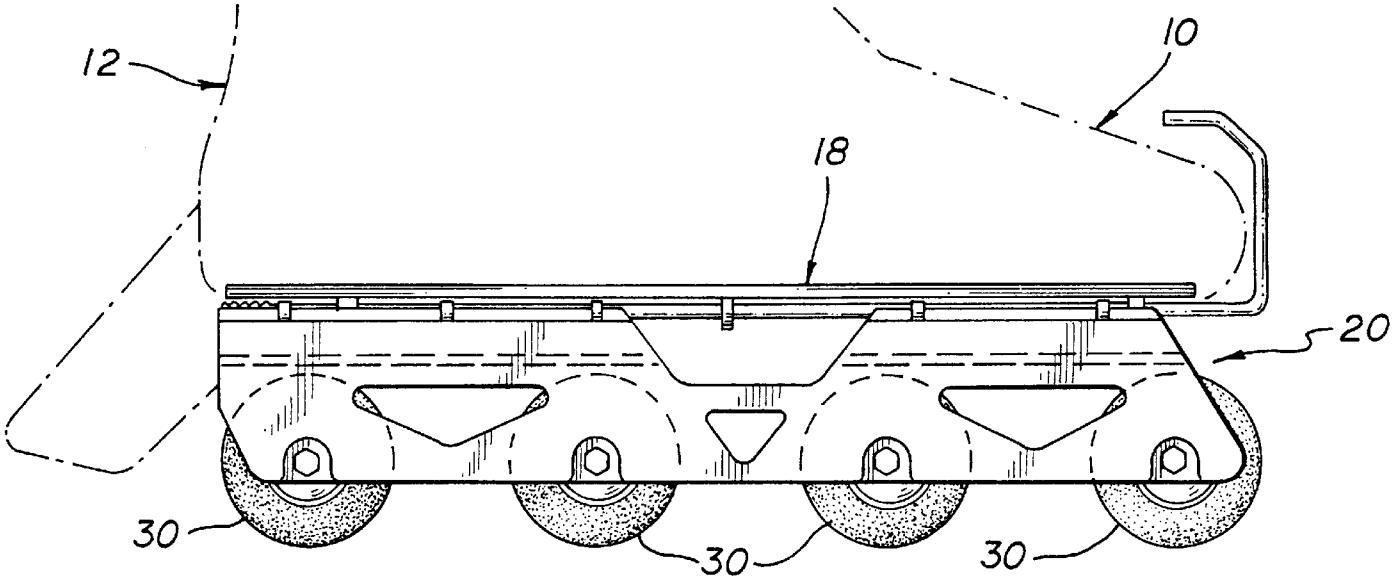
FIG. 1A is a right side elevation of a preferred embodiment of a right foot in-line skate assembly of the present invention.
Figure 1B:
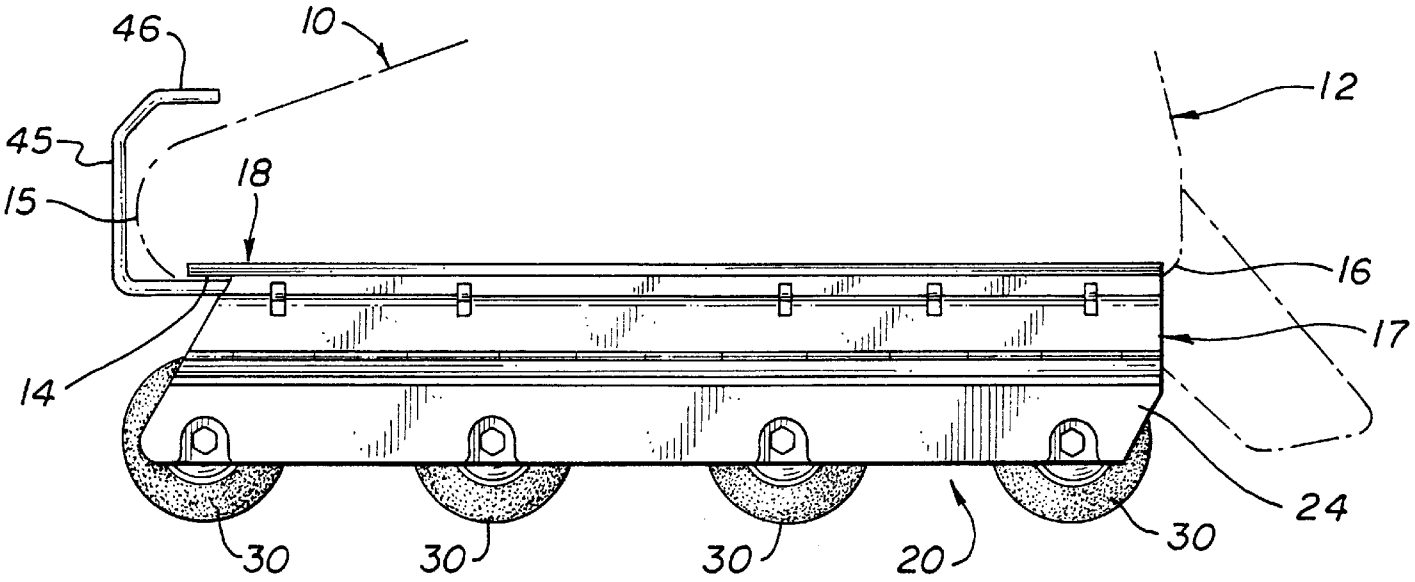
FIG. 1B is a left side elevation of the in-line skate of FIG. 1.

Referring to the several views of the drawings, there is generally illustrated the in-line skate 10 of the present invention. The in-line skate 10 includes a boot 12 structured and configured to be worn on the foot of a user in much the same manner as a conventional in-line skate. The boot 12 includes a toe portion 15, a heel 16, and bottom 14 which may be molded specifically for mating, attached receipt of a mounting plate 18 of bracket 17. A roller assembly 20 pivotally attaches to mounting plate 18 at correspondingly positioned hollow sleeves 19, 19' on the mounting plate bracket 17 and roller assembly 20, respectively, and includes an elongate rail 24 having a central elongate channel 26 and an integral sole plate 28 formed substantially along a length thereof. A plurality of wheels 30 are rotatably mounted along a length of the channel 26 in aligned, co-planar relation such than an axis of rotation 32 of each wheel is generally perpendicular to a longitudinal axis of the channel 26.

Figure 2:
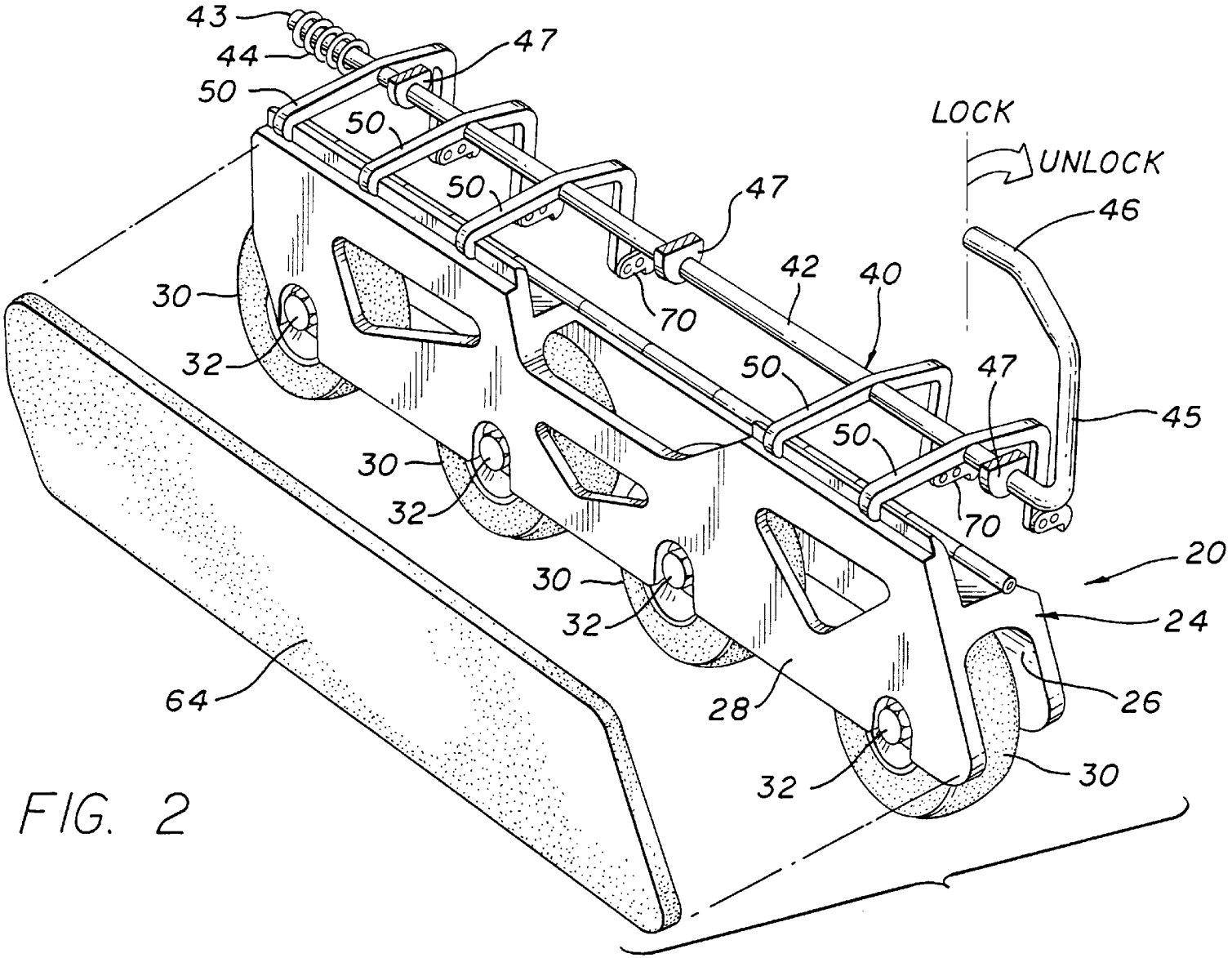
FIG. 2 is a partially exploded perspective view of a roller assembly of the present invention.
Figure 3C:
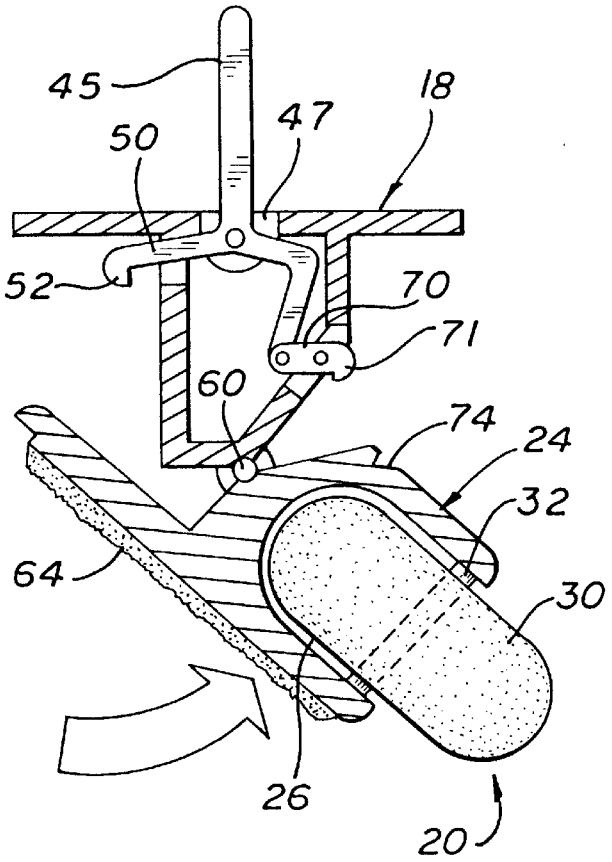
Figure 3D:
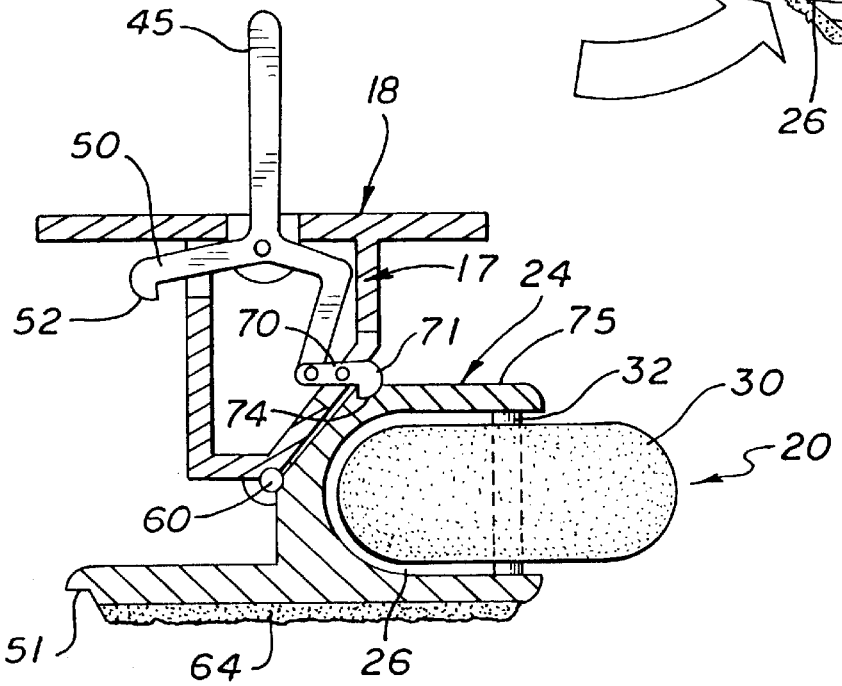
Figure 5:
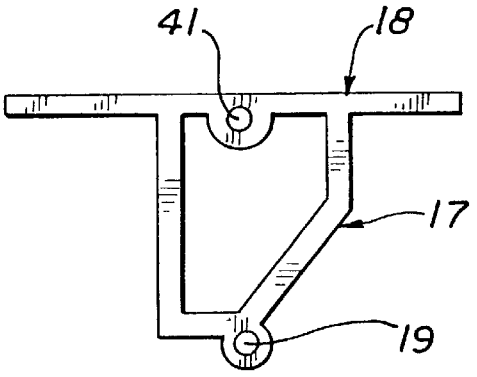
FIG. 5 is an isolated end elevation of the mounting plate bracket.

As best seen in FIGS. 2–3D, a locking assembly is provided and is pivotally fitted to the mounting plate at apertures 41 provided in sleeve 47 on the mounting plate 18. The locking assembly 40 includes a rod 42 which extends along a length of the bottom portion of the boot and includes a distal end 43 disposed near the rear of the boot 12, near the heel 16. A spring 44 urges the rod 42 rearward towards the heel 16 of the boot. The rod 42 further includes a generally U-shaped handle portion 45 extending upwardly at the toe portion 15 of the boot 12 and including a free distal end 46. The locking assembly 40 further includes a plurality of finger elements 50 extending from rod 42 at spaced intervals along its length. The finger elements 50 include a distal end 52 provided with a latch adapted to lock within a recessed lip 51 formed along an edge of the sole plate 28 when the roller assembly 20 is in the lowered, skating position. Upon releasing handle portion 45, the spring 44 urges the locking rod 42 forwardly and to a locked position so that the finger elements 50 are maintained within the recessed lip 51 and the free distal end 46 on the handle portion 45 is pointing up with the handle portion in a vertical position, thereby locking the roller assembly 20 in the lowered, skating position. In this locked position, the handle 45 and rod 42 cannot be rotated.

To disengage the roller assembly 20 and move it to the collapsed, stowed position, the handle portion 45 is pulled outwardly from the toe 15 of the boot 12. Then, by rotating the handle portion 45 approximately 20° to the right, as seen in FIG. 3B, the rod 42 rotates and the finger elements 50 are in turn raised to disengage from the lip 51, thereby releasing the roller assembly 20 from the locked, skating mode. This disengages the roller assembly 20 allowing it to be folded or rotated upwardly towards the boot bottom, about the pivot center 60, so that a rubber sole pad 64 on the exterior side of the sole plate 28 is generally parallel with the bottom 14 of the boot 12 for engagement with the ground surface when walking, thereby defining a walking mode, as seen in FIG. 3D. To maintain the roller assembly 20 in this position, a plurality of latch members 70 lockingly engage, at distal ends 71, to a lip 74 on the exterior side 75 of elongate rail 24 as seen in FIG. 3D.

To subsequently release the roller assembly 20 from the locked walking mode position, the handle portion 45 is again pulled outwardly from the boot toe and rotated approximately 20° to the right (as indicated by the arrow in FIG. 3B). This causes the latch members 70 to pivot resulting in the distal ends 71 releasing the lip 74. The roller assembly 20 can now be rotated back to the lowered, skating mode, shown in FIG. 3A.

While the instant invention has been shown and described in what is considered to be a preferred and practical embodiment thereof, it is recognized that departures may be made within the spirit and scope of the present invention which, therefore, should not be limited except as set forth within the following claims as interpreted under the doctrine of equivalents.

Now that the invention has been described,

What is claimed is:

1. An apparatus for use on a molded skate boot having a bottom, a toe portion, and a heel portion, said apparatus comprising:

a roller assembly including an elongate rail having a centrally disposed elongate channel with a longitudinal axis extending substantially along a length of said rail and a plurality of wheels rotatably mounted at spaced intervals along a length of said channel in aligned, co-planar relation, each of said wheels being mounted on an axis of rotation perpendicular to said longitudinal axis of said channel, mounting means for mounting said apparatus to the bottom of the skate boot and including a mounting plate structured for mating, fixed attachment to the skate boot bottom, said mounting means being pivotally attached to said roller assembly allowing said roller assembly to move relative to said mounting means and the skate boot bottom between a raised position defining a walking mode, wherein said axis of rotation of each of said wheels is generally perpendicular to the skate boot bottom and a lowered position defining a skating mode, wherein said axis of rotation of each of said wheels is generally parallel to the skate boot bottom, locking means for releasably locking said roller assembly in said raised and lowered positions, and a cushion sole mounted on said roller assembly for engaging a ground surface when said roller assembly is in said raised position in the walking mode.

2. An apparatus as recited in claim 1 wherein said roller assembly includes means thereon for locking engagement with said locking means in said raised and lowered positions.

3. An apparatus as recited in claim 2 wherein said roller assembly includes a sole plate integral with said rail and being structured and disposed for attachment of said cushion sole thereon.

4. An apparatus for use on a molded skate boot having a bottom, a toe portion, and a heel portion, said apparatus comprising:

a roller assembly including an elongate rail having a centrally disposed elongate channel with a longitudinal axis extending substantially along a length of said rail and a plurality of wheels rotatably mounted at spaced intervals along a length of said channel in aligned, co-planar relation, each of said wheels being mounted on an axis of rotation perpendicular to said longitudinal axis of said channel, mounting means fixed to the skate boot and being at least partially exposed on the bottom for pivotal attachment of said roller assembly thereto, said mounting means allowing said roller assembly to move relative to the skate boot bottom between a raised position defining a walking mode, and a lowered position defining a skating mode, locking means for releasably locking said roller assembly in said raised and lowered positions, and a sole mounted on said roller assembly for engaging a ground surface when said roller assembly is in said raised position in the walking mode.

5. An apparatus as recited in claim 4 wherein said roller assembly includes means thereon for locking engagement with said locking means in said raised and lowered positions.

6. An apparatus as recited in claim 4 wherein said sole includes a cushion thereon for engaging the ground surface.

7. An apparatus as recited in claim 6 wherein said roller assembly includes a sole plate integral with said rail and being structured and disposed for attachment of said cushion thereon.

8. An in-line skate comprising:

a skate boot having a bottom, a toe portion, and a heel portion, a roller assembly including an elongate rail having a centrally disposed elongate channel with a longitudinal axis extending substantially along a length of said rail and a plurality of wheels rotatably mounted at spaced intervals along a length of said channel in aligned, co-planar relation, each of said wheels being mounted on an axis of rotation perpendicular to said longitudinal axis of said channel, mounting means fixed to the skate boot and being at least partially exposed on the bottom for pivotal attachment of said roller assembly thereto, said mounting means allowing said roller assembly to move relative to the skate boot bottom between a raised position defining a walking mode, and a lowered position defining a skating mode, locking means for releasably locking said roller assembly in said raised and lowered positions, and a sole mounted on said roller assembly for engaging a ground surface when said roller assembly is in said raised position in the walking mode.

9. An apparatus as recited in claim 8 wherein said roller assembly includes means thereon for locking engagement with said locking means in said raised and lowered positions.

10. An apparatus as recited in claim 8 wherein said sole includes a cushion thereon for engaging the ground surface.

11. An apparatus as recited in claim 10 wherein said roller assembly includes a sole plate integral with said rail and being structured and disposed for attachment of said cushion thereon.

* * * * *